US012366366B2

(12) United States Patent
Wang et al.

(10) Patent No.: US 12,366,366 B2
(45) Date of Patent: Jul. 22, 2025

(54) FLOOR-STANDING AIR CONDITIONER INDOOR UNIT AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Bo Wang, Guangdong (CN); Jielin Peng, Guangdong (CN); Zhiyao Zhong, Guangdong (CN); Kailong Li, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 516 days.

(21) Appl. No.: 17/698,124

(22) Filed: Mar. 18, 2022

(65) Prior Publication Data

US 2022/0205649 A1 Jun. 30, 2022

Related U.S. Application Data

(63) Continuation of application No. PCT/CN2020/077794, filed on Mar. 4, 2020.

(30) Foreign Application Priority Data

Oct. 30, 2019 (CN) ..... 201911049230.6
Oct. 30, 2019 (CN) ..... 201921854320.8

(51) Int. Cl.
*F24F 1/0014* (2019.01)
*F24F 1/0033* (2019.01)
(Continued)

(52) U.S. Cl.
CPC ..... *F24F 1/0014* (2013.01); *F24F 1/0033* (2013.01); *F24F 1/005* (2019.02)

(58) Field of Classification Search
CPC ..... F24F 1/0014; F24F 1/0033; F24F 1/005
See application file for complete search history.

(56) References Cited

FOREIGN PATENT DOCUMENTS

CN 103776094 A * 5/2014
CN 105299858 A * 2/2016
(Continued)

OTHER PUBLICATIONS

Chen, CN103776094 and translation (Year: 2014).*
(Continued)

*Primary Examiner* — Steven S Anderson, II
(74) *Attorney, Agent, or Firm* — Scully, Scott, Murphy & Presser, P.C.

(57) ABSTRACT

A floor-standing air conditioner indoor unit and an air conditioner are provided. The indoor unit has a housing, a top air outlet frame, a fan assembly and a heat exchanger. The housing has an outer housing and an air duct housing in the outer housing. An air duct is formed in the air duct housing. The air duct housing has a rear air inlet and a front air outlet communicating with the air duct. A lower end of the top air outlet frame is in communication with the air duct. A top air outlet is formed on a front side of the top air outlet frame. The top air outlet frame is mounted on a top of the air duct housing and movable in a vertical direction to allow the top air outlet to extend out of the outer housing or retract into the air duct housing.

16 Claims, 8 Drawing Sheets

(51) Int. Cl.

| | |
|---|---|
| ***F24F 1/005*** | (2019.01) |
| ***F24F 11/79*** | (2018.01) |
| ***F24F 13/20*** | (2006.01) |

(56) References Cited

FOREIGN PATENT DOCUMENTS

| | | | | | |
|---|---|---|---|---|---|
| CN | 205561015 | U | | 9/2016 | |
| CN | 106287975 | A | | 1/2017 | |
| CN | 206073279 | U | | 4/2017 | |
| CN | 106855266 | A | | 6/2017 | |
| CN | 106918131 | A | | 7/2017 | |
| CN | 108375116 | A | * | 8/2018 | ..... F24F 1/0014 |
| CN | 108375117 | A | | 8/2018 | |
| CN | 109959074 | A | | 7/2019 | |
| CN | 110578968 | A | | 12/2019 | |
| CN | 110594866 | A | | 12/2019 | |
| CN | 110594867 | A | | 12/2019 | |
| CN | 110595032 | A | | 12/2019 | |
| CN | 110617555 | A | | 12/2019 | |
| CN | 110822685 | A | | 2/2020 | |
| CN | 111174280 | A | | 5/2020 | |
| CN | 210921595 | U | | 7/2020 | |
| KR | 20090098514 | A | * | 9/2009 | |
| KR | 20100053107 | A | * | 5/2010 | |
| KR | 20130043979 | A | | 5/2013 | |
| KR | 20160051095 | A | * | 8/2018 | |

OTHER PUBLICATIONS

Hou, CN105299858 and translation (Year: 2016).*
Cai, CN108375116 and translation (Year: 2018).*
Kim, KR20090098514 and translation (Year: 2009).*
Kim, KR20100053107 and translation (Year: 2010).*
Chun, KR20160051095 and translation (Year: 2016).*
First Office Action dated Jan. 25, 2024 received in Chinese Patent Application No. CN 201911049230.6.
Written Opinion dated Dec. 15, 2023 received in Korean Patent Application No. KR 10-2022-7009910.
International Search Report and Written Opinion dated Jul. 24, 2020 received in International Application No. PCT/CN2020/077794 together with an English translation.

* cited by examiner

FLOOR-STANDING AIR CONDITIONER INDOOR UNIT AND AIR CONDITIONER

CROSS-REFERENCE TO RELATED APPLICATIONS

This application is a continuation application of PCT International Application No. PCT/CN2020/077794, filed on Mar. 4, 2020, which claims priority to and benefits of Chinese Patent Application No. 201911049230.6, filed on Oct. 30, 2019, and Chinese Patent Application No. 201921854320.8, filed on Oct. 30, 2019, the entire disclosure of which are incorporated herein by reference for all purposes. No new matter has been introduced.

FIELD

The present disclosure relates to the technical field of air conditioners, and in particular, to a floor-standing air conditioner indoor unit and an air conditioner.

BACKGROUND

With the continuous improvement of living standards, air conditioners are increasingly widely used in people's daily lives. Nowadays, various types of air conditioners on the market have relatively simple air outlet forms. For example, a floor-standing air conditioner indoor unit usually has a conventional air outlet on the panel, the air supply range is limited, and the air supply form is single, which cannot meet the different needs of users and affects the user experience. In addition, the floor-standing air conditioner indoor unit also usually adopts the air supply mode with a single air duct, which has a small air intake area, the air supply distance is not sufficiently long, the air supply range is limited, the heat exchange efficiency is low, and the comfort level provided to the users is poor.

SUMMARY

An objective of the present disclosure is to provide a floor-standing air conditioner indoor unit, which aims to solve at least the technical problem of the limited air supply range of the floor-standing air conditioner indoor unit in the prior art, which affects the user experience.

In order to achieve at least the above objective, the present disclosure provides a floor-standing air conditioner indoor unit, including:

- a housing, including an outer housing and an air duct housing disposed in the outer housing, an air duct being formed in the air duct housing, the air duct housing being provided with a rear air inlet and a front air outlet communicating with the air duct;
- a top air outlet frame, a lower end of the top air outlet frame being in communication with the air duct, a top air outlet being formed on a front side of the top air outlet frame, the top air outlet frame being mounted on a top of the air duct housing and movable in a vertical direction to enable the top air outlet to extend out of the outer housing or retract into the air duct housing;
- a fan assembly, installed in the air duct, and configured to draw airflow into the air duct housing from the rear air inlet, and blow out from the front air outlet or out from the front air outlet and the top air outlet; and
- a heat exchanger installed in the outer housing and located behind the air duct housing.

In an embodiment, the air duct housing includes an air duct rear housing and an air duct front housing connected to the air duct rear housing, and the air duct is formed between the air duct front housing and the air duct rear housing; and

- the fan assembly includes a centrifugal fan, the rear air inlet includes a first air inlet defined on the air duct rear housing, the air duct includes a first air duct formed between the first air inlet and the front air outlet, a lower end of the top air outlet frame is in communication with the first air duct, and the centrifugal fan is provided in the first air duct.

In an embodiment, the fan assembly further includes an axial flow fan, the rear air inlet further includes a second air inlet defined on the air duct rear housing, the second air inlet is located above the first air inlet, the front air outlet corresponds to the second air inlet, the air duct further includes a second air duct formed between the second air inlet and the front air outlet, and the axial flow fan is provided in the second air duct.

In an embodiment, an air guide cylinder is installed at the second air inlet, the air guide cylinder is extended towards the front air outlet, and the axial flow fan is installed in the air guide cylinder.

In an embodiment, an area of the front air outlet is larger than an area of a front port of the air guide cylinder.

In an embodiment, the air guide cylinder is integrally formed on the air duct rear housing, a gap is formed between an outer wall of the air guide cylinder and an inner side wall of the air duct rear housing, and the lower end of the top air outlet frame is in communication with the first air duct through the gap.

In an embodiment, both sides of the outer wall of the air guide cylinder are provided with vertical planes, and the vertical planes are in parallel with the inner side wall of the air duct rear housing.

In an embodiment, a stationary blade is provided in the second air duct and faces the axial flow fan, and the axial flow fan is located between the second air inlet and the stationary blade.

In an embodiment, a front air outlet frame is provided on the air duct front housing corresponding to the axial flow fan, and the front air outlet is formed on the front air outlet frame.

In an embodiment, a display light strip is installed on a front side of the front air outlet frame, and the display light strip corresponds to the front air outlet.

In an embodiment, the front air outlet frame is installed with a lateral air guide assembly, the lateral air guide assembly includes a plurality of lateral air guide plates spaced apart in the vertical direction, and a lateral driving member configured to drive the lateral air guide plates to swing.

In an embodiment, the front air outlet frame is further installed with a vertical air guide assembly, the vertical air guide assembly includes a plurality of vertical air guide plates spaced apart in a horizontal direction, and a vertical driving member configured to drive the vertical air guide plates to swing.

In an embodiment, the floor-standing air conditioner indoor unit further includes:

- a driving device installed in the air duct housing, the driving device being connected to the top air outlet frame and configured to drive the top air outlet frame to move up and down.

The present disclosure further provides an air conditioner, including an air conditioner outdoor unit and the floor-standing air conditioner indoor unit as described above. The floor-standing air conditioner indoor unit is connected to the air conditioner outdoor unit through a refrigerant pipe.

In the present disclosure, when the floor-standing air conditioner indoor unit is working, the airflow enters the outer housing and exchanges heat with the heat exchanger. The air after heat exchange is sucked into the air duct housing from the rear air inlet and blown out from the front air outlet along the air duct to the room. In addition, the floor-standing air conditioner indoor unit has a top air outlet mode. When it is necessary to supply air from the top air outlet, the floor-standing air conditioner indoor unit enters the top air outlet mode, and the top air outlet frame moves upward, such that the top air outlet extends out of the outer housing, and part of the airflow in the air duct is blown out from the front air outlet to the room, another part of the airflow is blown into the top air outlet frame from the lower end of the top air outlet frame, and is blown out into the room through the top air outlet. Thus, the front air outlet and the top air outlet supply air at the same time, which expands the air supply range. In addition, moving the top air outlet frame up and down can adjust the air supply height and air supply range of the top air outlet frame to meet the different needs of users. When it is not necessary to supply air from the top air outlet, the floor-standing air conditioner indoor unit exits the top air outlet mode, the top air outlet frame moves down, so that the top air outlet retracts into the air duct housing, at this time, all the airflow in the air duct is blown into the room from the front air outlet, and the top air outlet no longer supplies air to the room, which further meets the different needs of users and improves the user experience.

BRIEF DESCRIPTION OF THE DRAWINGS

In order to more clearly illustrate the embodiments of the present disclosure, drawings used in the embodiments will be briefly described below. Obviously, the drawings in the following description are only some embodiments of the present disclosure. It will be apparent to those skilled in the art that other figures can be obtained according to the structures shown in the drawings without creative work.

Figure 1:
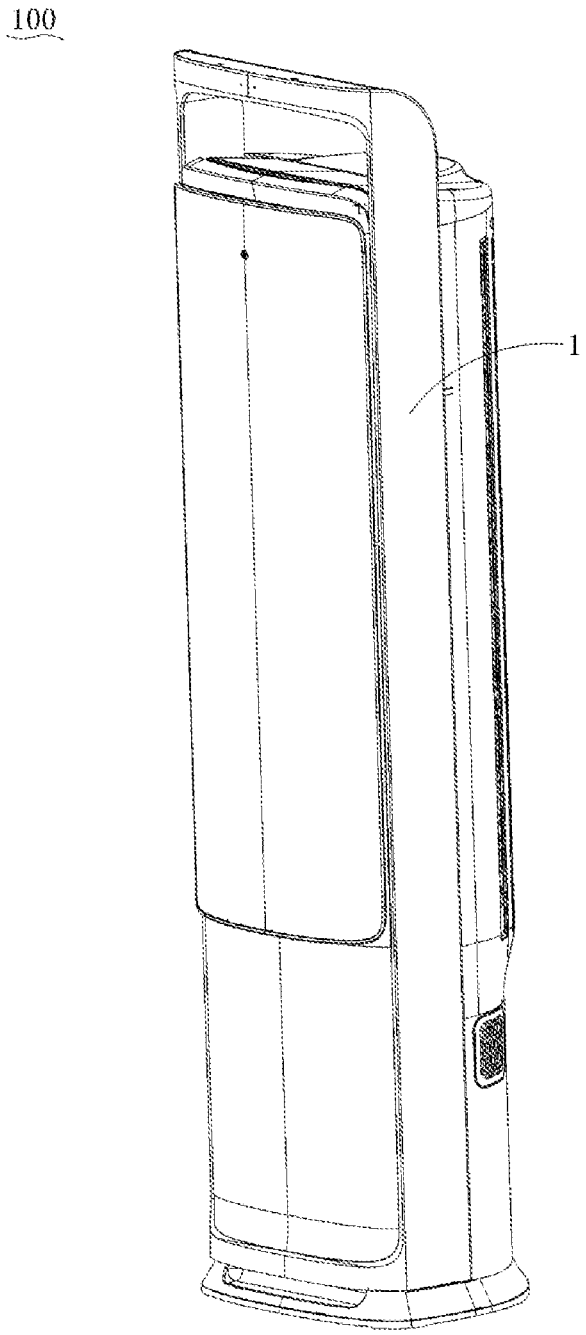
FIG. 1 is a schematic perspective view according to an embodiment of the present disclosure.

Description of reference signs shown in the figures is provided in the following table.

| Reference sign | Name |
|---|---|
| 100 | floor-standing air conditioner indoor unit |
| 1 | outer housing |
| 11 | front door panel |
| 12 | panel assembly |
| 13 | rear box body |
| 14 | chassis |
| 2 | air duct housing |
| 20 | air duct |
| 201 | first air duct |
| 202 | second air duct |
| 21 | air duct rear housing |
| 211 | rear air inlet |
| 211a | first air inlet |
| 211b | second air inlet |
| 22 | air duct front housing |
| 221 | front air outlet |
| 23 | air guide cylinder |
| 231 | vertical cut edge |
| 24 | front air outlet frame |
| 3 | top air outlet frame |
| 31 | top air outlet |
| 4 | fan assembly |
| 41 | centrifugal fan |
| 42 | axial flow fan |
| 5 | stationary blade |
| 6 | display light strip |
| 7 | lateral air guide plate |
| 8 | vertical air guide plate |
| 9 | heater exchanger |

The realization of the objective, functional characteristics, and advantages of the present disclosure are further described with reference to the accompanying drawings.

DETAILED DESCRIPTION OF EMBODIMENTS

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

It should be noted that, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. Besides, the meaning of "and/or" appearing in the disclosure includes three parallel schemes. For example, "A and/or B" includes only A, or only B, or both A and B.

The present disclosure provides a floor-standing air conditioner indoor unit.

In an embodiment of the present disclosure, as shown in FIG. 1 to FIG. 5, the floor-standing air conditioner indoor unit 100 includes a housing, a top air outlet frame 3, a fan assembly 4 and a heat exchanger 9. The housing includes an outer housing 1 and an air duct housing 2 disposed in the outer housing 1, an air duct 20 is formed in the air duct housing 2, the air duct housing 2 is provided with a rear air inlet 211 and a front air outlet 221 communicating with the air duct 20. A lower end of the top air outlet frame 3 is in communication with the air duct 20, a top air outlet 31 is formed on a front side of the top air outlet frame 3, and the top air outlet frame 3 is mounted on a top of the air duct housing 2 and movable in a vertical direction to enable the top air outlet 31 to extend out of the outer housing 1 or retract into the air duct housing 2. The fan assembly 4 is installed in the air duct 20 and configured to draw airflow into the air duct housing 2 from the rear air inlet 211, and blow out from the front air outlet 221 or out from the front air outlet 221 and the top air outlet 31. The heat exchanger 9 is installed in the outer housing 1 and located behind the air duct housing 2.

The front air outlet 221 in this embodiment refers to the side facing the user after the floor-standing air conditioner indoor unit 100 is installed in place, and the rear air inlet 211 is on the side away from the user. The lower end and the front side of the top air outlet frame 3 are both open, the front side opening forms a top air outlet 31, and the lower end opening communicates with the air duct 20 in the air duct housing 2. The top air outlet 31 can be disposed on the same side as the front air outlet 221, which is also the side facing the user. The top air outlet frame 3 can be moved up and down on the top of the air duct housing 2, such that the top air outlet 31 of the top air outlet frame 3 can extend out of the outer housing 1 during the upward movement, or retract into the air duct housing 2 during the downward movement.

In this embodiment, when the floor-standing air conditioner indoor unit 100 is working, the airflow enters the outer housing 1 and exchanges heat with the heat exchanger 9. The air after heat exchange is sucked into the air duct housing 2 from the rear air inlet 211 and blown out from the front air outlet 221 along the air duct 20 to the room. In addition, the floor-standing air conditioner indoor unit 100 has a top air outlet mode. When it is necessary to supply air from the top air outlet 31, the floor-standing air conditioner indoor unit enters the top air outlet mode, and the top air outlet frame 3 moves upward, such that the top air outlet 31 extends out of the outer housing 1, that is, the top air outlet 31 is exposed to the outer housing 1, part of the airflow in the air duct 20 is blown out from the front air outlet 221 to the room, another part of the airflow is blown into the top air outlet frame 3 from the lower end of the top air outlet frame 3, and is blown out into the room through the top air outlet 31. Thus, the front air outlet 221 and the top air outlet 31 supply air at the same time, which expands the air supply range. In addition, moving the top air outlet frame 3 up and down can adjust the air supply height and air supply range of the top air outlet frame 3 to meet the different needs of users. When it is not necessary to supply air from the top air outlet 31, the floor-standing air conditioner indoor unit 100 exits the top air outlet mode, the top air outlet frame 3 moves down, so that the top air outlet 31 retracts into the air duct housing 2, that is, the top air outlet 31 is hidden in the air duct housing 2, at this time, all the airflow in the air duct 20 is blown into the room from the front air outlet 221, and the top air outlet 31 no longer supplies air to the room, which further meets the different needs of users and improves the user experience.

In this embodiment, the floor-standing air conditioner indoor unit 100 can realize the simultaneous air supply from the front air outlet 221 and the top air outlet 31, thereby expanding the air supply range. The air supply height and air supply range of the top air outlet frame 3 can also be adjusted, which is flexible and convenient to use, and can also realize independent air supply from the front air outlet 221 to meet the different usage needs of users and improve the user experience.

The air duct housing 2 of this embodiment includes an air duct rear housing 21 and an air duct front housing 22 connected to the air duct rear housing 21, and the air duct 20 is formed between the air duct front housing 22 and the air duct rear housing 21. The fan assembly 4 includes a centrifugal fan 41, the rear air inlet 211 includes a first air inlet 211*a* defined on the air duct rear housing 21, the air duct 20 includes a first air duct 201 formed between the first air inlet 211*a* and the front air outlet 221, a lower end of the top air outlet frame 3 is in communication with the first air duct 201, and the centrifugal fan 41 is provided in the first air duct 201. The fan assembly 4 further includes an axial flow fan 42, the rear air inlet 211 further includes a second air inlet 211*b* defined on the air duct rear housing 21, the second air inlet 211*b* is located above the first air inlet 211*a*, the front air outlet 221 corresponds to the second air inlet 211*b*, the air duct 20 further includes a second air duct 202 formed between the second air inlet 211*b* and the front air outlet 221, and the axial flow fan 42 is provided in the second air duct 202.

For example, in this embodiment, a first air inlet 211*a* is defined at a position close to a bottom of the air duct rear housing 21. A second air inlet 211*b* is defined at a position near a top of the air duct rear housing 21. A front air outlet 221 is defined at a position near a top of the air duct front housing 22, and the front air outlet 221 is facing the second air inlet 211*b*. The centrifugal fan 41 is located below the axial flow fan 42. The air supply principle of the centrifugal fan 41 is axial air influx and radial air outflux. Thus, when the centrifugal fan 41 is working, the centrifugal fan 41 can guide the airflow into the first air duct 201 from the first air inlet 211*a*, the airflow runs upward along the first air duct 201 and is blown out to the front side through the front air outlet 221. The air supply principle of the axial flow fan 42 is axial air inlet and axial air outlet. Therefore, when the axial flow fan 42 is working, the axial flow fan 42 can guide the airflow from the second air inlet 211*b* to enter the second air duct 202 and blow out to the front side through the front air outlet 221. The dashed arrows in FIG. 6 to FIG. 8 indicate the flow direction of the airflow.

It should be noted that, in an embodiment, when the temperature difference between the indoor ambient temperature and the ideal temperature required by the user is small, the centrifugal fan 41 or the axial flow fan 42 can be selected to work alone. That is, only the centrifugal fan 41 participates in the air supply, or only the axial flow fan 42 participates in the air supply. In another embodiment, when the temperature difference between the indoor ambient temperature and the ideal temperature required by the user is large, the centrifugal fan 41 and the axial flow fan 42 can be selected to work simultaneously. That is, the centrifugal fan 41 and the axial flow fan 42 can participate in the air supply at the same time, which increases the air intake area, the air supply distance is longer, and the air supply range is enlarged, and the heat exchange efficiency is improved, and the comfort is improved. In addition, in this embodiment, compared with the air supply mode with the single air duct, the air supply mode with double air duct 20 of the first air duct 201 and the second air duct 202 increases the air intake area, such that the intake air flow is uniform, the heat exchange of the heat exchanger 9 is uniform, the heat exchange efficiency is improved, and the energy efficiency of the system is improved. In the case of the same air volume, compared with the air supply mode with the single air duct 20, the noise of the air supply mode with the double air duct 20 is also reduced, thereby reducing noise pollution. According to the actual needs of the user, the centrifugal fan 41 or the axial flow fan 42 can be selected to work alone, or the centrifugal fan 41 or the axial flow fan 42 can be selected to work simultaneously.

Figure 5:
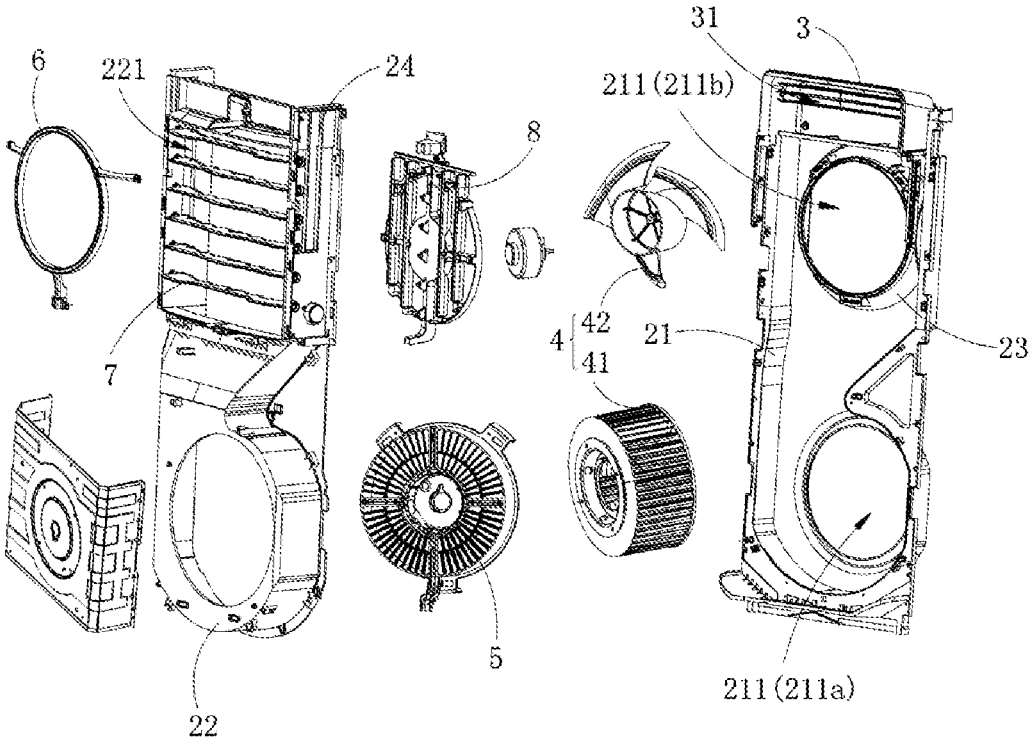
FIG. 5 is an exploded schematic view with a part of the structure removed according to an embodiment of the present disclosure.
Figure 6:
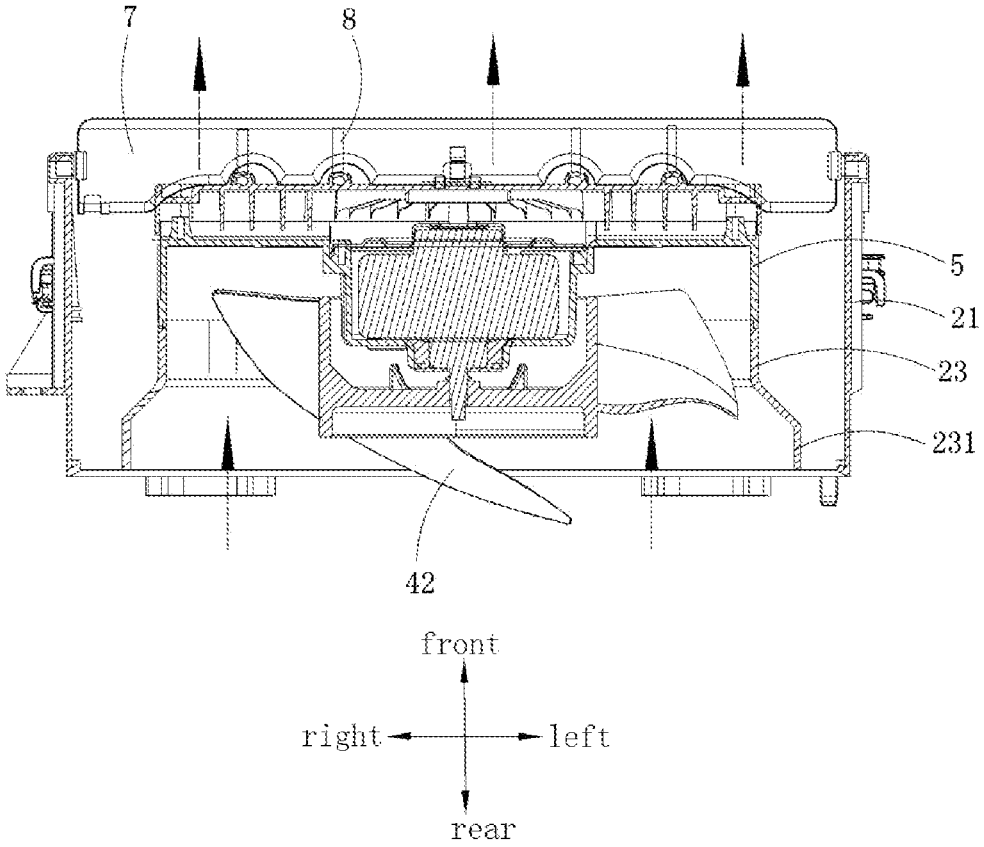
FIG. 6 is a schematic cross-sectional view with a part of the structure removed according to an embodiment of the present disclosure.
Figure 7:
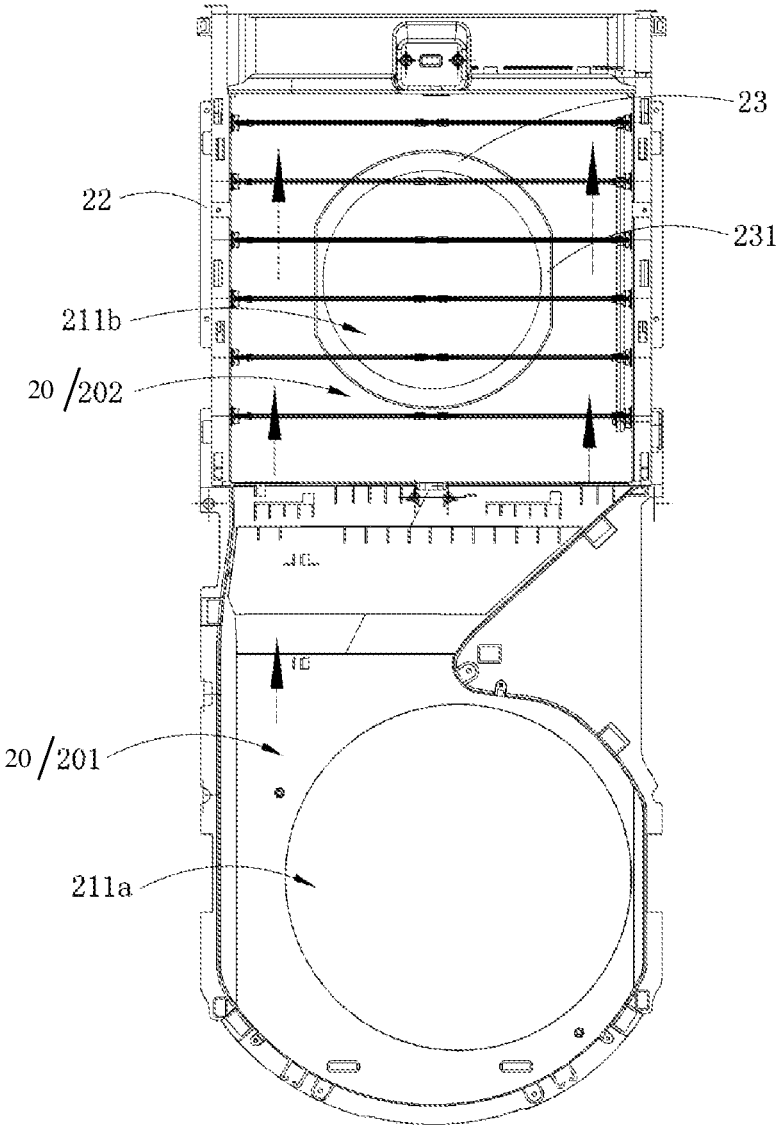
FIG. 7 is a schematic front view with a part of the structure removed according to an embodiment of the present disclosure.
Figure 8:
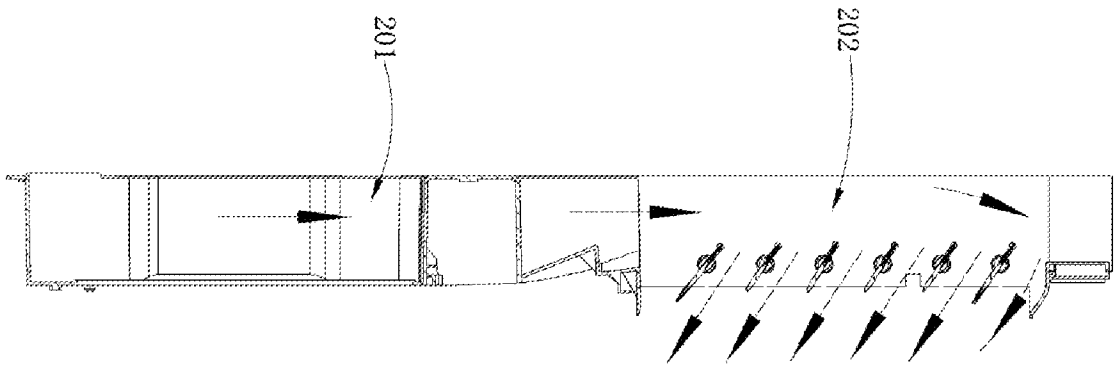
FIG. 8 is a schematic side view with a part of the structure removed according to an embodiment of the present disclosure.

In this embodiment, an air guide cylinder 23 is installed at the second air inlet 211*b*, the air guide cylinder 23 is extended towards the front air outlet 221, and the axial flow fan 42 is installed in the air guide cylinder 23. An area of the front air outlet 221 is larger than an area of a front port of the air guide cylinder 23. As shown in FIG. 5 to FIG. 7, the air guide cylinder 23 of this embodiment is trumpet-shaped. The rear port of the air guide cylinder 23 is connected to the edge of the second air inlet 211*b*, and the front port of the air guide cylinder 23 extends to one side of the front air outlet 221. The inner diameter of the air guide cylinder 23 is reduced from the back to the front. The axis of the axial flow fan 42 and the axis of the air guide cylinder 23 are located on the same straight line. The air sucked into the second air duct 202 from the second air inlet 211*b* can be gradually concentrated in the axial direction of the axial flow fan 42 along the air guide cylinder 23, which is convenient for the axial flow fan 42 to supply air. The area of the front air outlet 221 is larger than the area of the front port of the air guide cylinder 23, which is beneficial to expand the air supply range.

Further, the air guide cylinder 23 is integrally formed on the air duct rear housing 21, which is not only easy to manufacture, but also omits assembly gaps and errors, and has good structural stability. A gap is formed between an outer wall of the air guide cylinder 23 and an inner side wall of the air duct rear housing 21, and a lower end of the top air outlet frame 3 is in communication with the first air duct 201 through the gap. When the floor-standing air conditioner indoor unit enters the top air outlet mode, the centrifugal fan 41 works, the airflow in the first air duct 201 is blown upward into the top air outlet frame 3 through the gap, so as to realize air supply from the top air outlet 31. When the floor-standing air conditioner indoor unit exits the top air outlet mode, the centrifugal fan 41 works, and when the air flow passes through the gap, a negative pressure can be formed in the first air duct 201. Under the action of negative pressure, an air current flowing toward the front air outlet 221 can be formed in the first air duct 201, thus the air output volume of the floor-standing air conditioner indoor unit 100 can be increased, the air supply distance can be increased, and the heat exchange efficiency of the floor-standing air conditioner indoor unit 100 can be improved.

As shown in FIG. 6 and FIG. 7, both sides of the outer wall of the air guide cylinder 23 are provided with vertical planes 231, and the vertical planes 231 are in parallel with the inner side wall of the air duct rear housing 21. The vertical planes 231 increases the gap width, such that the airflow in the first air duct 201 passes through the gap smoothly and enters the top air outlet frame 3 in a large amount, thereby increasing the air volume of the top air outlet 31 and improving the effectiveness of the top air outlet mode.

In this embodiment, a stationary blade 5 is provided in the second air duct 202, the stationary blade 5 is facing the axial flow fan 42, and the axial flow fan 42 is located between the second air inlet 211*b* and the stationary blade 5. The stationary blade 5 can re-integrate the airflow, so that the air output from the axial flow fan 42 is more uniform and the noise can be reduced.

In this embodiment, a front air outlet frame 24 is provided on the air duct front housing 22 corresponding to a position of the axial flow fan 42, and the front air outlet 221 is formed at the front air outlet frame 24. A display light strip 6 is installed on a front side of the front air outlet frame 24, and the display light strip 6 corresponds to the front air outlet 221. The display light strip 6 in this embodiment has the function of prompting. For example, when cold air is blown out from the front air outlet 221, the display light strip 6 is blue, indicating that the floor-standing air conditioner indoor unit 100 is currently in the cooling mode. When hot air is blown out from the front air outlet 221, the display light strip 6 turns red, indicating that the floor-standing air conditioner indoor unit 100 is currently in the heating mode. It can be understood that the display light strip 6 can control the display color through the temperature sensor. The display light strip 6 in this embodiment can not only play a prompting role, but also improve the appearance aesthetics of the floor-standing air conditioner indoor unit 100.

Further, the front air outlet frame 24 is installed with a lateral air guide assembly and a vertical air guide assembly. The lateral air guide assembly includes a plurality of lateral air guide plates 7 spaced apart in the vertical direction, and a lateral driving member configured to drive the lateral air guide plates 7 to swing. The vertical air guide assembly includes a plurality of vertical air guide plates 8 spaced apart in a horizontal direction, and a vertical driving member configured to drive the vertical air guide plates 8 to swing. Both the lateral driving member and the vertical driving member in this embodiment can be a motor.

As shown in FIG. 3 to FIG. 6, in this embodiment, the plurality of lateral air guide plates 7 are spaced apart along the up-down direction, and the lateral driving member can drive the plurality of lateral air guide plates 7 to swing up and down synchronously. A plurality of vertical air guide plates 8 are spaced apart along the left-right direction, and the vertical driving member can drive the plurality of vertical air guide plates 8 to swing left and right synchronously, so as to change the air supply direction and air supply range to meet the needs of users.

The floor-standing air conditioner indoor unit further includes a driving device installed in the air duct housing 2, and the driving device is connected to the top air outlet frame 3 and configured to drive the top air outlet frame 3 to move up and down. In this embodiment, the driving device can be a device such as a screw mechanism or a rack-and-pinion mechanism that can drive the top air outlet frame 3 to move up and down. For example, the driving device is a rack and pinion mechanism. The upper end of the rack is connected with the top air outlet frame 3, and the lower end of the rack is engaged with the gear, By driving the gear to rotate by the motor, the top air outlet frame 3 can be driven to move up and down by the rack, so as to realize or stop the air outlet from the top air outlet 31.

Figure 2:
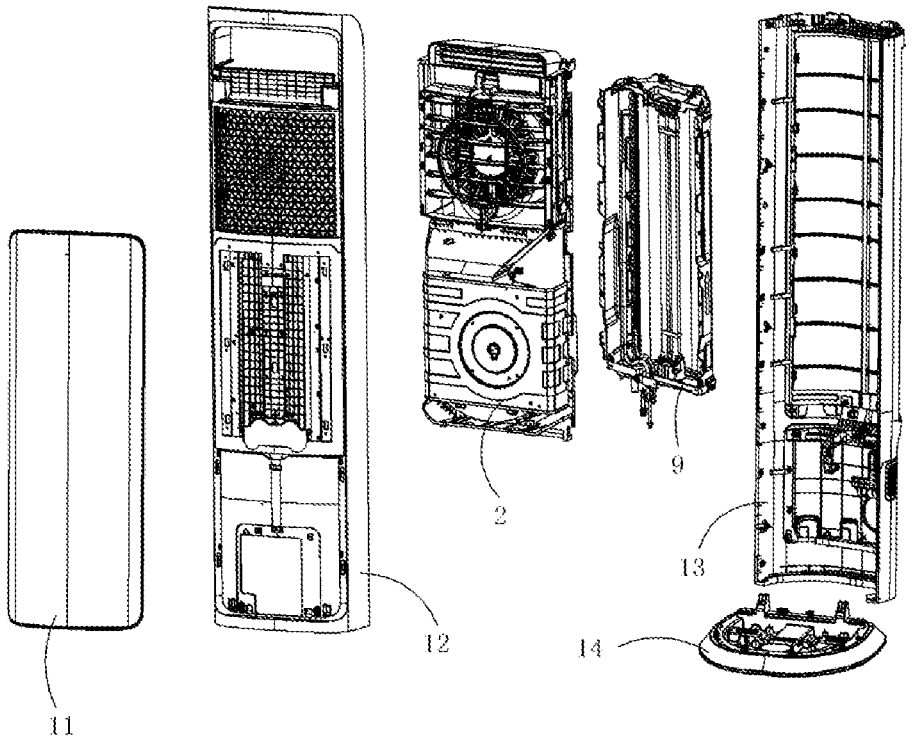
FIG. 2 is a schematic exploded view according to an embodiment of the present disclosure.
Figure 3:
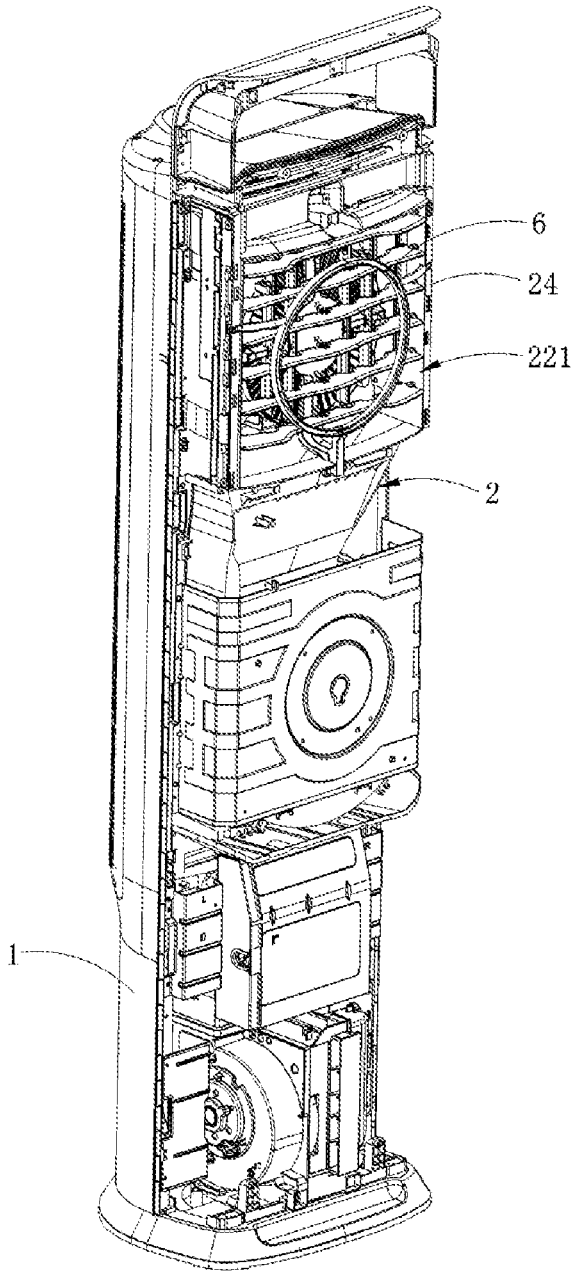
FIG. 3 is a schematic perspective view with a part of the housing removed according to an embodiment of the present disclosure.
Figure 4:
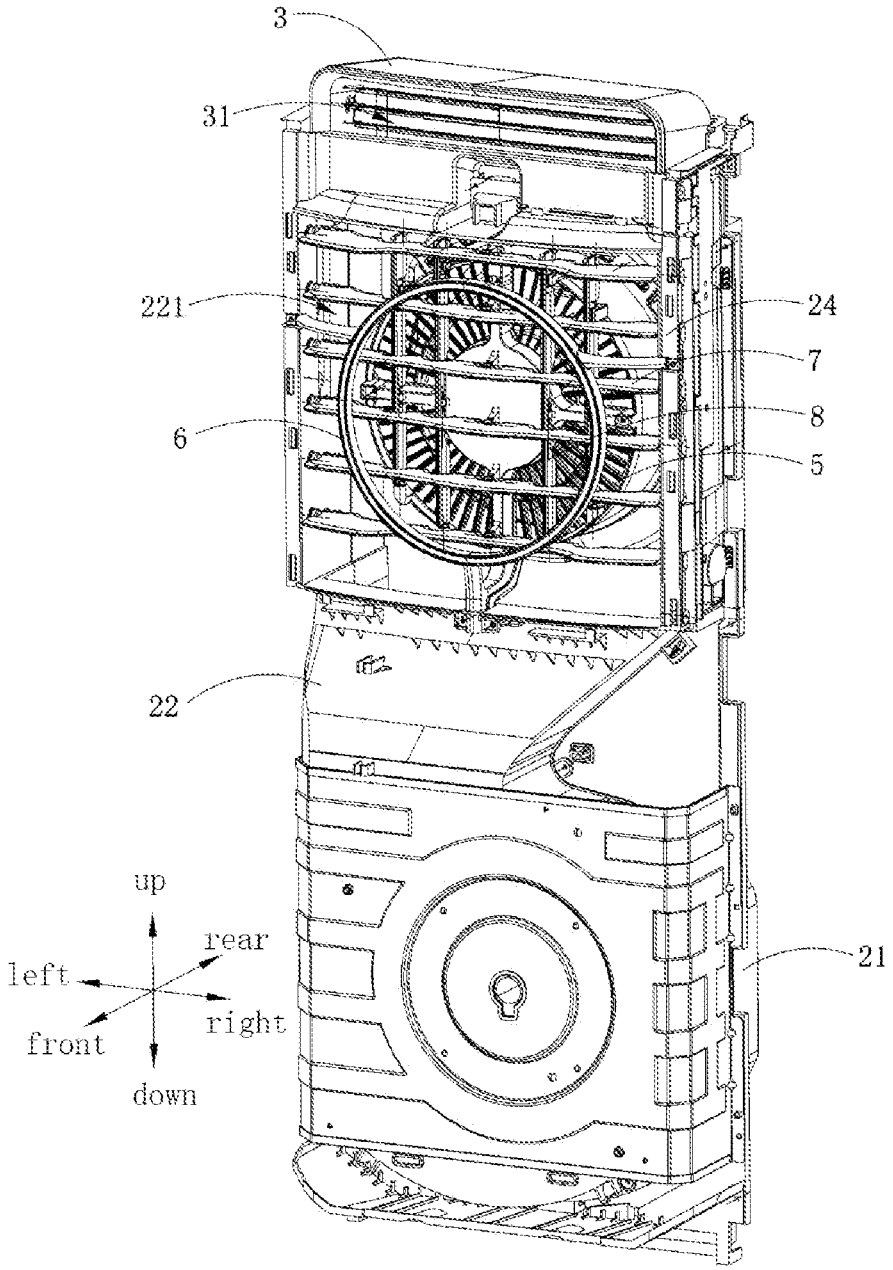
FIG. 4 is an assembly schematic view with a part of the structure removed according to an embodiment of the present disclosure.

As shown in FIG. 2, the housing 1 of the floor-standing air conditioner indoor unit 100 includes a front door panel 11, a panel assembly 12, a rear box body 13 and a chassis 14. The front door panel 11 is provided on the front side of the panel assembly 12. The rear box body 13 is installed on the rear side of the panel assembly 12, and is surrounded by the panel assembly 12 to form a cavity for installing the air duct housing 2 and the heat exchanger 9. The chassis 14 is provided on the bottom of the panel assembly 12 and the rear box body 13 to play a supporting role.

The present disclosure further provides an air conditioner, including an air conditioner outdoor unit and a floor-standing air conditioner indoor unit 100 connected to the air conditioner outdoor unit through a refrigerant pipe. The specific structure of the floor-standing air conditioner indoor unit 100 refers to the above-mentioned embodiments. Since the air conditioner adopts all the technical solutions of the above-mentioned embodiments, it has at least all the effects brought about by the technical solutions of the above-mentioned embodiments, which will not be repeated herein.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A floor-standing air conditioner indoor unit comprising:

a housing comprising an outer housing and an air duct housing disposed in the outer housing, an air duct being formed in the air duct housing, the air duct housing being provided with a rear air inlet and a front air outlet communicating with the air duct;

a top air outlet frame, a lower end of the top air outlet frame being in communication with the air duct, a top air outlet being formed on a front side of the top air outlet frame, the top air outlet frame being provided on a top of the air duct housing and movable in a vertical direction between an open configuration in which the top air outlet extends out of the outer housing and a closed configuration in which the top air outlet is retracted into the air duct housing;

a fan assembly provided in the air duct, wherein the fan assembly is configured to draw airflow into the air duct housing from the rear air inlet and through the air duct in a direction towards the top air outlet, to blow at least a portion of the airflow traveling towards the top air outlet out from the front air outlet when the top air outlet is in the closed configuration and to blow at least a portion of the airflow traveling towards the top air outlet out from both the front air outlet and the top air outlet when the top air outlet is in the open configuration; and a heat exchanger provided in the outer housing and located behind the air duct housing, wherein:

the air duct housing comprises an air duct rear housing and an air duct front housing connected to the air duct rear housing, and the air duct is formed between the air duct front housing and the air duct rear housing;

the fan assembly comprises a centrifugal fan, the rear air inlet comprises a first air inlet defined on the air duct rear housing, the air duct comprises a first air duct formed between the first air inlet and the front air outlet, a lower end of the top air outlet frame is in communication with the first air duct, and the centrifugal fan is provided in the first air duct;

the fan assembly further comprises an axial flow fan;

the rear air inlet further comprises a second air inlet defined on the air duct rear housing;

the second air inlet is located above the first air inlet;

the front air outlet corresponds to the second air inlet;

the air duct further comprises a second air duct formed between the second air inlet and the front air outlet; and the axial flow fan is provided in the second air duct.

2. The floor-standing air conditioner indoor unit of claim 1, wherein:

an air guide cylinder is provided at the second air inlet, the air guide cylinder is extended towards the front air outlet, and the axial flow fan is provided in the air guide cylinder.

3. The floor-standing air conditioner indoor unit of claim 1, wherein an area of the front air outlet is larger than an area of a front port of the air guide cylinder.

4. The floor-standing air conditioner indoor unit of claim 1, wherein:

the air guide cylinder is integrally formed on the air duct rear housing, a gap is defined between an outer wall of the air guide cylinder and an inner side wall of the air duct rear housing, the lower end of the top air outlet frame is in communication with the first air duct through the gap; and both sides of the outer wall of the air guide cylinder are provided with vertical planes, and the vertical planes are in parallel with the inner side wall of the air duct rear housing.

5. The floor-standing air conditioner indoor unit of claim 1, wherein:

a stationary blade is provided in the second air duct and faces the axial flow fan, and the axial flow fan is located between the second air inlet and the stationary blade.

6. The floor-standing air conditioner indoor unit of claim 1, wherein a front air outlet frame is provided on the air duct front housing corresponding to the axial flow fan, and the front air outlet is formed on the front air outlet frame.

7. The floor-standing air conditioner indoor unit of claim 6, wherein a display light strip is provided on a front side of the front air outlet frame, and the display light strip corresponds to the front air outlet.

8. The floor-standing air conditioner indoor unit of claim 6, wherein:

the front air outlet frame is provided with a lateral air guide assembly; and the lateral air guide assembly comprises: a plurality of lateral air guide plates spaced apart in the vertical direction, and a lateral driving member configured to drive the lateral air guide plates to swing.

9. The floor-standing air conditioner indoor unit of claim 6, wherein:

the front air outlet frame is further provided with a vertical air guide assembly; and the vertical air guide assembly comprises: a plurality of vertical air guide plates spaced apart in a horizontal direction, and a vertical driving member configured to drive the vertical air guide plates to swing.

10. The floor-standing air conditioner indoor unit of claim 1, further comprising:

a driving device provided in the air duct housing, the driving device being connected to the top air outlet frame and configured to drive the top air outlet frame to move up and down.

11. The floor-standing air conditioner indoor unit of claim 1, wherein the front air outlet of the air duct is positioned between the rear air inlet and the top air outlet along a flow path of the airflow from the rear air inlet to the top air outlet.

12. An air conditioner comprising:

an air conditioner outdoor unit; and a floor-standing air conditioner indoor unit connected to the air conditioner outdoor unit through a refrigerant pipe;

the floor-standing air conditioner indoor unit comprising:

a housing comprising an outer housing and an air duct housing disposed in the outer housing, an air duct being formed in the air duct housing, the air duct housing being provided with a rear air inlet and a front air outlet communicating with the air duct;

a top air outlet frame, a lower end of the top air outlet frame being in communication with the air duct, a top air outlet being formed on a front side of the top air outlet frame, the top air outlet frame being movably mounted on a top of the air duct housing in a vertical direction between an open configuration in which the top air outlet extends out of the outer housing and a closed configuration in which the top air outlet is retracted into the air duct housing;

a fan assembly provided in the air duct, wherein the fan assembly is configured to draw airflow into the air duct housing from the rear air inlet and through the air duct in a direction towards the top air outlet, to blow at least a portion of the airflow traveling towards the top air outlet out from the front air outlet when the top air outlet is in the closed configuration and to blow at least a portion of the airflow traveling towards the top air outlet out from both the front air outlet and the top air outlet when the top air outlet is in the open configuration; and a heat exchanger provided in the outer housing and located behind the air duct housing, wherein:

the air duct housing comprises an air duct rear housing and an air duct front housing connected to the air duct rear housing, and the air duct is formed between the air duct front housing and the air duct rear housing;

the fan assembly comprises a centrifugal fan, the rear air inlet comprises a first air inlet defined on the air duct rear housing, the air duct comprises a first air duct formed between the first air inlet and the front air outlet, a lower end of the top air outlet frame is in communication with the first air duct, and the centrifugal fan is provided in the first air duct;

the fan assembly further comprises an axial flow fan;

the rear air inlet further comprises a second air inlet defined on the air duct rear housing;

the second air inlet is located above the first air inlet;

the front air outlet corresponds to the second air inlet;

the air duct further comprises a second air duct formed between the second air inlet and the front air outlet; and the axial flow fan is provided in the second air duct.

13. The air conditioner of claim 12, wherein an air guide cylinder is provided at the second air inlet, the air guide cylinder is extended towards the front air outlet, and the axial flow fan is provided in the air guide cylinder.

14. The air conditioner of claim 13, wherein an area of the front air outlet is larger than an area of a front port of the air guide cylinder.

15. The air conditioner of claim 13, wherein:

the air guide cylinder is integrally formed on the air duct rear housing, a gap is defined between an outer wall of the air guide cylinder and an inner side wall of the air duct rear housing, a lower end of the top air outlet frame is in communication with the first air duct through the gap, and both sides of the outer wall of the air guide cylinder are provided with vertical planes, and the vertical planes are in parallel with the inner side wall of the air duct rear housing.

16. The air conditioner of claim 12, wherein the front air outlet of the air duct is positioned between the rear air inlet and the top air outlet along a flow path of the airflow from the rear air inlet to the top air outlet.

* * * * *